United States Patent [19]

Krawczyk

[11] Patent Number: 4,567,075

[45] Date of Patent: Jan. 28, 1986

[54] DOUBLE FACED KNIT FABRIC AND METHOD

[75] Inventor: Simon W. Krawczyk, Forest Hills, N.Y.

[73] Assignee: Fab Industries, Inc., New York, N.Y.

[21] Appl. No.: 496,434

[22] Filed: May 20, 1983

[51] Int. Cl.[4] ..... B32B 33/00

[52] U.S. Cl. ..... 428/91; 5/482; 28/162; 66/194; 428/85; 428/253

[58] Field of Search ..... 428/85, 91, 253; 5/482; 28/162; 66/194

[56] References Cited

U.S. PATENT DOCUMENTS

| | | | |
|---|---|---|---|
| 3,434,306 | 3/1969 | Auville et al. | 66/194 |
| 3,517,530 | 6/1970 | Magnus | 66/194 |
| 4,193,137 | 3/1980 | Heck | 66/194 |
| 4,199,633 | 4/1980 | Blore | 428/91 |
| 4,298,643 | 11/1981 | Miyagawa et al. | 428/91 |

*Primary Examiner*—James J. Bell

*Attorney, Agent, or Firm*—Abelman Frayne Rezac & Schwab

[57] ABSTRACT

A nappable, dimensionally stable fabric is produced on a three bar warp knitting machine by over feeding the yarns fed by the bottom bar to provide nappable loops, and by knitting the yarns fed by the top bar in a pattern providing nappable floats, longitudinal stability being provided by yarns knit from the middle bar, and lateral stability being provided by the partially napped floats.

15 Claims, 17 Drawing Figures

DOUBLE FACED KNIT FABRIC AND METHOD

FIELD OF THE INVENTION

This invention relates to a knit double-faced fabric having particular utility for bedding blankets and apparel, which is light-weight and has excellent thermal insulation properties, permeability, and has hand and feel at least comparable or even superior to woven and finished Cashmere fabric produced by conventional methods.

BACKGROUND OF THE INVENTION

In the past, and up to today, most quality bedding blankets are woven. The conventional manner of forming fabrics for use as bedding blankets involves the weaving of yarns on a flat bed loom, and the subsequent finishing of the woven fabric to increase or enhance its bulk and stability, followed by various brushing or napping operations to raise the pile and loft of the fibers. As the selvedge is unfinished it must be hemmed. Further, shedding and pilling is experienced due to the broken fibers resulting from the napping and brushing operations employed in the formation of the pile and loft. While this problem can be minimized through the use of a greater density of heavier yarns the resultant fabric has been relatively expensive to create.

Two alternative fabrics and methods of creating them have more recently been employed. One teaches the manufacture of blankets employing non-woven fabrics and the other the manufacture of blankets employing flocked fabrics.

Non-woven fabrics are formed by needle looming fiber batts to produce an integrated fabric which are then subjected to napping and brushing operations. These non-woven fabrics have permitted the manufacture of a less expensive high loft blanket, but often do not achieve the drape and hand of woven blankets, and, the blankets are often subject to localized weaknesses which result in the formation of holes after prolonged use. Additionally, difficulty is experienced in controlling shedding and pilling, the control of this problem usually requiring chemical bonding of the napped and raised fibers, and the further loss of drape and hand of the fabric.

Where flocked fabrics have been utilized as a blanket fabric, generally short staple fibers are attached to a fabric surface with an adhesive facing either by spray deposition or by an electrostatic method. Velvet-like surfaces may be formed by employing flock fiber with lengths of approximately 1 mm, and plush-like surfaces may be formed by employing flock fibers with lengths of approximately 1.5 mm or more.

Flocked blanket fabric, while providing the tactile quality of a velvet or plush, has many deficiencies. For example, the overall hand of the fabric is sponge-like, and sections of the fabric under hand pressure ofen exhibit a rubber-like resistance and lacks the drape and hand of conventionally woven blanket fabrics. Further, delamination and wearing away of the flock often results in bald spots, a result often encountered in dry cleaning or laundering. Carefully controlled conditions of care are thus often required to prevent damage to the blanket.

Heretofore the creation of quality blanket materials by knitting has not been considered practical. By and large such knitted materials have had extremely poor stability, especially in the transverse or warp direction.

Further, blanket materials have raised faces on both surfaces or faces of the blanket. This requires that both faces be napped and raised to create dual fleece-like facings. However, known knit fabrics do not retain dimensional stability and integrity when subjected to napping on both faces.

While knitted fabrics having a single fleece-facing are well known in the art, these single faced fabrics generally do not have the dimensional stability required of blanket material. Such fabrics may be made in a number of known ways, including knitting facing yarns into a knitted substrate and overfeeding of the facing yarn to create enlarged loops which can be napped and brushed to create a fleece surface.

An example of this technique is disclosed in U.S. Pat. No. 3,090,097, to Ruckstuhl, issued May 21, 1963. Ruckstuhl teaches a conventional nap construction produced on a double bar warp knit loom, the direction of travel of the respective bars being uni-directional, and resulting in a knitted fabric which subsequently can be processed into a single faced velvet-like knitted fabric.

It has been suggested that the loops may be presented on both surfaces of the substrate, such as shown in U.S. Pat. No. 3,434,306 to Auville et al. issued Mar. 25, 1969. Auville et al. teaches the manufacture of warp knit terry fabrics employing a double bar knitting machine in which the yarns of one of the bars is overfed to provide a double-sided terry fabric. However, in providing loops on both faces, the knit structure becomes dimensionally unstable, and would therefore be unsatisfactory as a blanket material.

In U.S. Pat. No. 3,255,615, to Schwartz, issued June 14, 1966, a double-sided terry loop warp knit fabric is created using a modified Atlas stitch. In order to provide loops on both faces, Schwartz teaches the knitting of one-half of his loops on one side of the fabric and a loop lay-in on the lap side of the fabric. The substrate is therefore vulnerable to severe weakening if the resultant fabric is subjected to napping to raise the pile and loft of the facing yarn. As a result it is unsuitable as a blanket material. Further, even if napping were possible, the fabric is unstable dimensionally in both the longitudinal and the lateral directions.

Where a third bar has been employed in the knitting, known three bar constructions do not provide the stability and necessary surface characteristics for blankets. For example, U.S. Pat. No. 3,517,530, to Magnus, issued June 30, 1970, teaches the formation of a terry loop fabric knit on a three bar warp knit machine. In addition to being dimensionally unstable, the fabric does not produce a nappable surface on the lap side.

Similarly, in U.S. Pat. No. 4,193,137, to Heck, issued Mar. 18, 1980, where a warp knitted fabric having pile loops on both of its faces is provided, the fabric is unsuitable for napping operations, in that napping will significantly weaken the structural integrity of the fabric, even further reducing its dimensional stability.

THE INVENTIVE CONCEPT

The present inventive overcomes these problems and provides a highly suitable knit blanket fabric of three bar construction which retains its stability both in the longitudinal direction and in the transverse or walewise direction, and is nappable on both surfaces without appreciably affecting the substrate, the characteristics of the fabric being at least equal to and even superior to those of quality woven blankets. The present invention further teaches a novel method by which the knitted greige material can be napped and brushed to create a luxurious pile and loft with exceptional hand and feel.

The fabric of the present invention includes a substrate to provide longitudinal stability; a first face which includes overfed loops; and, an opposite face which includes floats which are both nappable and provide lateral stability after napping.

The unique method of the present invention teaches the napping of the knit fabric in a manner which raises the loops away from the substrate to prevent untoward injury of the substrate during the napping.

According to the present invention the middle bar of a three bar warp knit machine knits the substrate; the bottom bar knits an overfed looped facing into the substrate; and the top bar knits into the substrate a lap facing comprised of floats, the floats preferably having a stitch interval in excess of the stitch interval of the looped facing.

The substrate provides a longitudinally stable carrier for the face yarns. The overfed loops of the bottom bar are of a length and density sufficient to not only provide a desirable fleece surface when napped, but in addition to shield the substrate from damage during the napping. The top bar floats provide lateral stability even when napped.

Various combinations of yarns and deniers can be employed for an almost infinite variety of patterns and colors. The loop face and the opposite float face may be knit of any suitable yarns, and the respective yarns can be of materials and colors different from each other. Thus the characteristics of each face may be different, and, if the yarns are pre-dyed, each of the facings may have a color different from the other. By employing conventional jacquard knitting techniques it is possible to produce patterned fabric having an intaglio appearance on its respective faces.

If the fabric is knit of undyed yarns and then dyed, a jet dying process to bulk up the fabric may be employed. If the dye retentivity characteristics of the yarns differs, then, the resultant fabric will have differing shades of color on the face and back of the fabric.

The fabric is then subjected to napping operations, preferably a sequential processing of each face, sufficient to raise and loft the pile of the respective facings while maintaining the integrity of the yarns of the lap facing, and without structurally weakening the yarns of the substrate.

Preferably, the lap face or float face of the fabric is first subjected to one or more napping operations to raise and loft the pile of the float facing. During this operation, the respective floats are raised and bowed, thus protecting the substrate from damage. After an initial napping operation, or intermediate sequential napping operations, the fabric is optionally tentered to tensionally stress the intact fibers of the floats, and ready the fabric for subsequent napping operations.

The napping of the floats and the tensioning of the fibric draws in the fabric and the loops on the loop face of the fabric are urged to a more erect presentation from their knit orientation, which is somewhat inclined to the plane of the fabric. This presentation of the loops to somewhat erect position permits the subsequent napping of the loops without damage to the substrate.

The napping of the loops is performed in one or more napping operations, and if necessary, the fabric is tentered intermediate the napping operations. After the final napping operation the fabric is framed and heat set.

The yarns are preferably thermosetting yarns such as polyester so that the finishing heat set will provide further dimensional stability and will permit laundering and drying in conventional household washers and dryers.

The physical properties of the fabric, such as the feel of the respective faces, can readily be predetermined by pre-selection of yarns and sizes of the yarns. The drape, weight, surface, pile and hand of the finished fabric can also be pre-selected and can be modified by varying yarns and the length of the stitch intervals of the respective facings. In general a soft hand is easily achieved as the runs of the floats are free to flex relative to the substrate and the fibers of the napped loop facing are similarly free to bend relative to the substrate at positions intermediate the stitch intervals of the loops.

If desired, a fabric can be knit employing four or more bars to produce patterns or textures in the finished fabric.

DESCRIPTION OF THE DRAWINGS

The invention will now be described with reference to the accompanying drawings which illustrate preferred embodiments of the invention, and in which.

DESCRIPTION OF THE PREFERRED EMBODIMENTS

Figure 1:
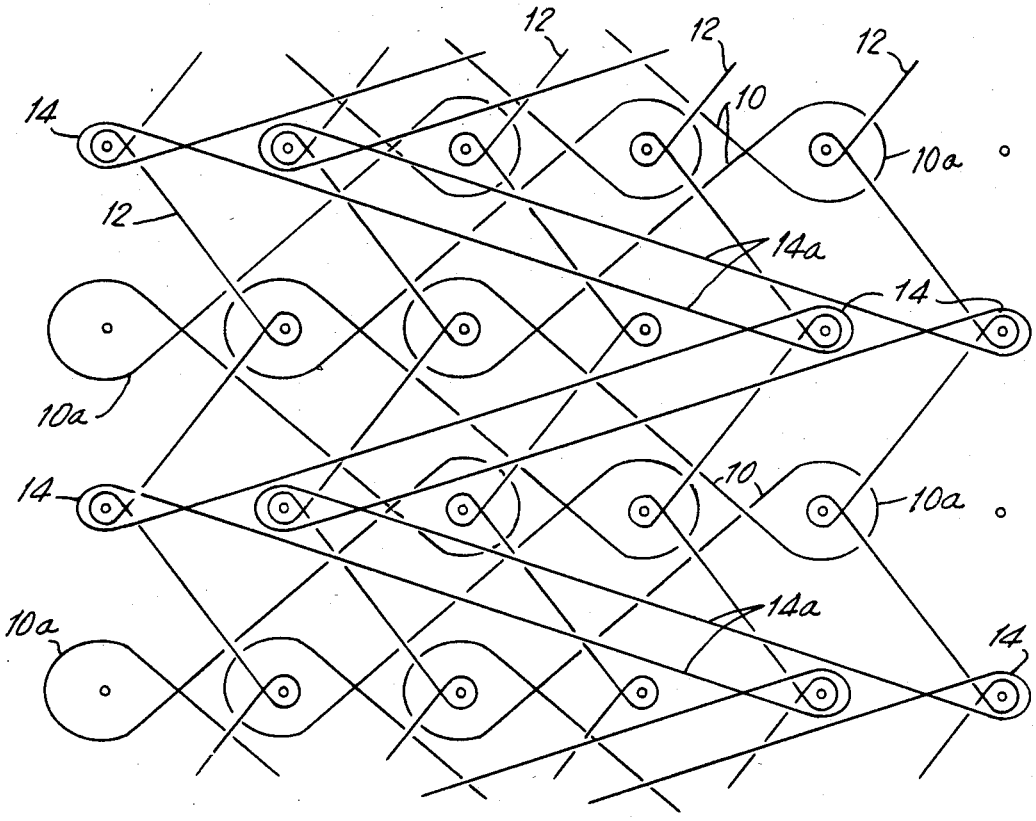
FIG. 1 is a composite stitch diagram of a preferred form of three bar knitted fabric according to the present invention.

Referring now to FIG. 1, the yarns fed by the bottom bar and which provide the loop face of the fabric are indicated at 10; the yarns fed by the middle bar and which provide the substrate for the fabric are indicated at 12; and, the yarns fed by the top bar and which provide the float face of the fabric are indicated at 14.

Figure 2:
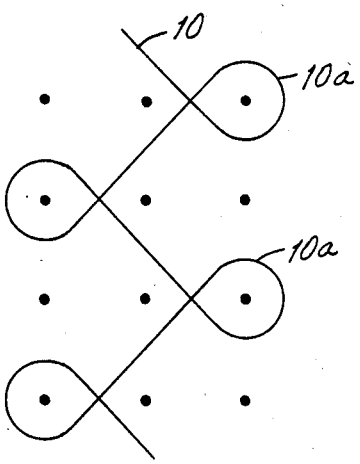
FIGS. 2, 3 and 4 are alternative stitch diagrams of a loop facing of the fabric, the preferred embodiment appearing in FIG. 1 being shown in FIG. 2.

In this embodiment, the knitting pattern for the yarns 10 is 1,0–2,3, as is more clearly shown in FIG. 2. The yarns 10 are overfed such that they provide loops 10*a* at each stitch, an appropriate sinker (not shown) being employed for this purpose. Preferably, the yarns are overfed and controlled by the sinker to produce loops of approximately 0.1 mm or more in height.

Figure 5:
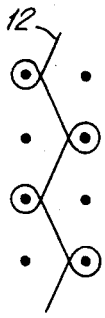
FIGS. 5, 6 and 7 are alternative stitch diagrams of the substrate or stabilizing core of the fabric, the preferred embodiment appearing in FIG. 1 being shown in FIG. 5.

Simultaneously with the knitting of the yarns 10, the yarns 12 are knit by the middle bar under normal tension on a pattern of 1,0–1,2, as shown in FIG. 5.

Figure 8:
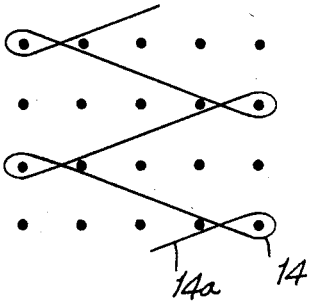
FIGS. 8, 9 and 10 are alternative stitch diagrams of the float facing of the fabric, the preferred embodiment appearing in FIG. 1 being shown in FIG. 8.

Simultaneously with the knitting of the yarns 10 and 12, the yarns 14 are knit by the top bar under normal tension on a pattern of 1,0–4,5, as shown in FIG. 8. The yarns 14 lie over the yarns 10 and 12, and the floats of the yarns 14 extend freely and can be moved out of the plane of the knit fabric.

The yarns 14, as knit into the courses of the substrate comprised of the yarns 12, stabilize the warps of the substrate in the transverse or weft direction, and, additionally preclude any unintended tensioning of the loop yarns 10, which would result in the withdrawal of the loops into the substrate.

Figure 3:
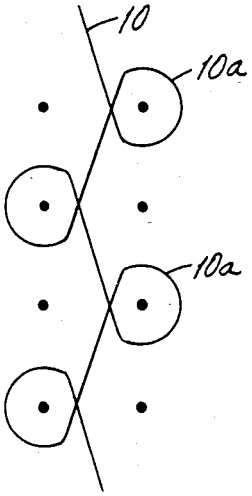
Figure 4:
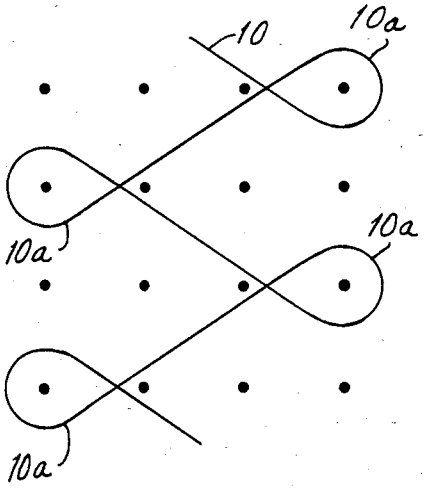

Variations in the knitting patterns of each of the respective yars are possible while still maintaning the lateral stability of the fabric. As illustrated in FIG. 3, the yarns 10 can be knit 1,0–1,2 or, 1,0–2,3.

If desired, the length of the loop may be greater than the 1,0–3,4 of FIG. 2. Increasing the stitch intervals of the loop yarn 10 will result in an increase in the weight of the fabric and an increase of the loop density of the loop face and the bulk thereof after napping. The bulk or the weight may also be modified by varying the yarn size, the preferable range of stitch interval is from 1,0–1,2 to 1,0–5,6.

Figure 7:
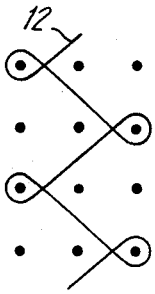
Figure 6:
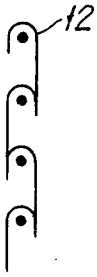

As shown in FIGS. 6 and 7, the stitch intervals of the yarn 12 of the substrate may be increased from 1,0–1,2 to 1,0–2,3. While furthr increase of the stitch length may be made, the increasing of the underlap or stitch length beyond 1,0–2,3 will tend to reduce longitudinal stability. The substrate can be also of chain or pillar stitch, having a pattern 1,0–0,1. Provided that sufficient stability is given to the fabric in the transverse direction by the float of back and front bars, the use of a chain or pillar stitch will result in a fabric having excellent longitudinal stability. However, a substrate made with stitch 1,0–1,2 is preferable because it provides a lateral connection between wales thus increasing the strength and stability of the fabric.

Figure 9:
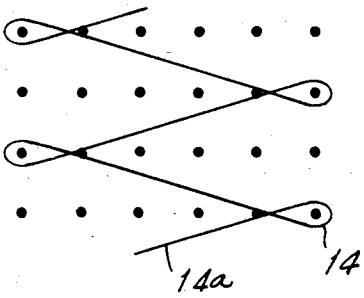
Figure 10:
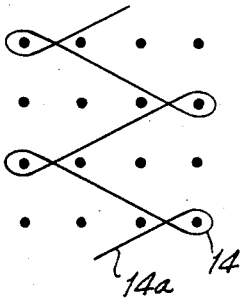

As shown in FIGS. 9 and 10, the stitch intervals of the float yarns 14 can be increased to 1,0–5,6 or greater, or reduced to 1,0–3,4 or less. The increase in the length of the floats provides for greater bulking of the float face during napping. Decreasing the length of the float will have the opposite effect, and will decrease the density of the napped float face. The preferable range of knitting pattern is 1,0–3,4 to 1,0–5,6. As there is a relationship between the two outer faces, the ranges of each will be determined by the other.

Figure 11:
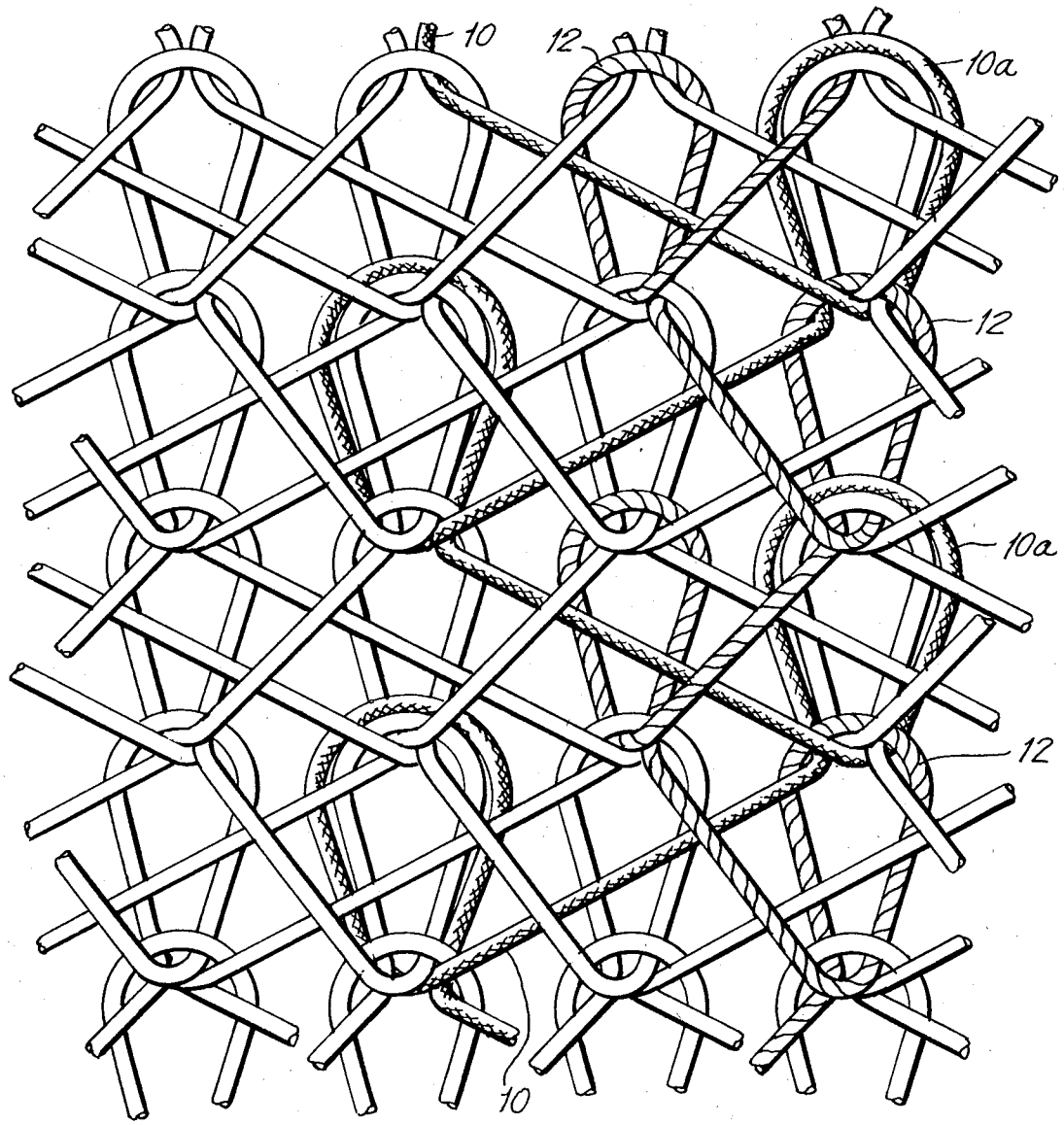
FIG. 11 is a stitch illustration of the combined loop facing and the substrate, the float facing having been omitted for clarity of illustration.

FIG. 11 illustrates the stitch pattern of the yarns 10 and 12, the floats of the yarns 14 having been omitted for the sake of clarity. One of the yarns 10 of the loop face is shown starred, and one of the yarns 12 of the knit substrate is shown cross-hatched. The loop yarns 10 are overfed and knit on the pattern 1,0–2,3, it being understood that all loops are overfed and thus enlarged. The substrate yarns 10 are knit on the pattern 1,0–1,2.

As the yarns 10 are knit in with the loops presented away from the substrate, the loops 10*a* may be napped without napping the substrate. Napping of the substrate is to be avoided as it will weaken or even destroy the substrate. If weakened during the napping operation holes in the fabric would eventually result, particularly under the stress of launderings.

Figure 12:
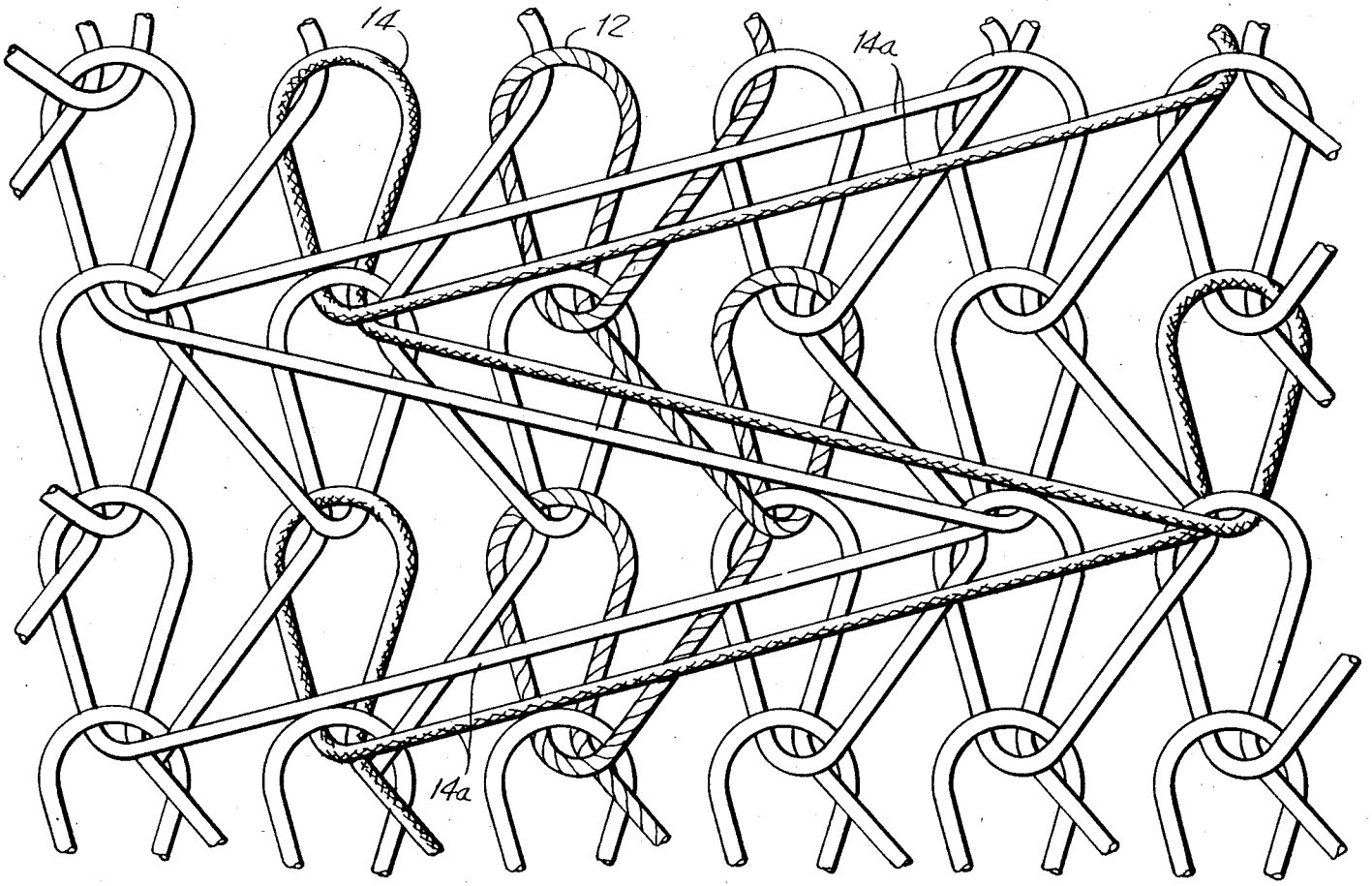
FIG. 12 is a stitch illustration of the float face of the fabric and the substrate, the loop face having been omitted for clarity of illustration.

Referring now to FIG. 12 the lap face knit on the pattern 1,0–4,5 is illustrated to show the stitch pattern of the yarns 12 and 14, the yarn 10 having been omitted for clarity. In FIG. 12 one of the yarns 12 of the knit substrate is shown cross-hatched, and one of the yarns 14 of the floats is shown starred, the yarns 14 having been knit on the pattern 1,0–4,5. The yarn 14 is knit into the substrate with floats 14*a* which extend across the face of the fabric opposite that of the loop face. The yarns 14 are fed under normal tension, and provide lateral stability to the fabric.

The floats 14*a* are readily nappable and can be napped without napping and damage of the substrate. During the napping operation, the floats will be lifted and pulled away from the plane of the fabric and the napping wires will be spaced from the substrate.

Figure 13:
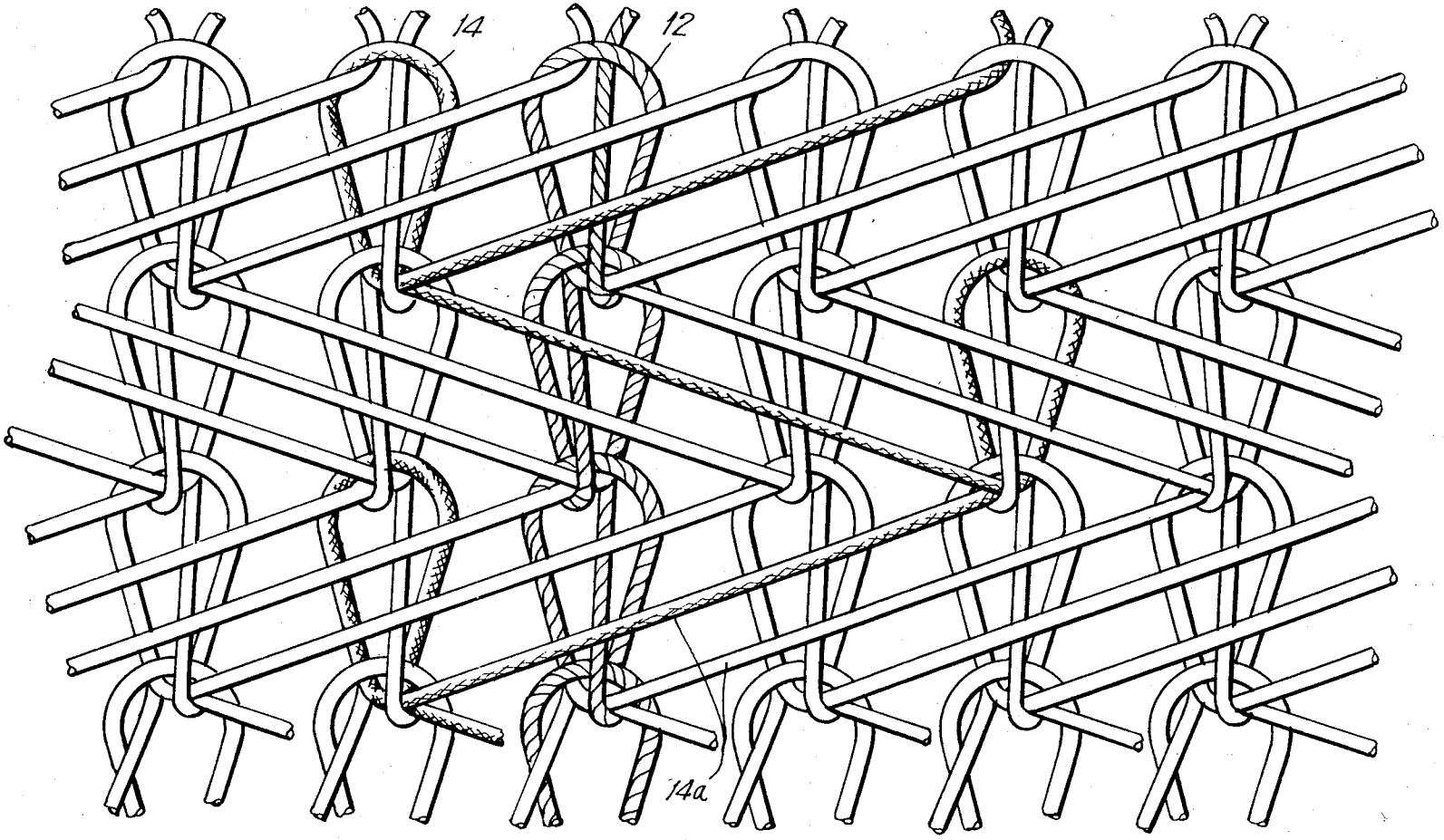
FIG. 13 is a stitch illustration of the fabric illustrating a pillar chain construction of substrate.

Since the floats 14*a* provide lateral stability to the fabric, the substrate is not required to resist transverse stretching, and thus can be formed as a chain or pillar stitch as illustrated in FIG. 13. The chain stitch or pillar stitch substrate provides stability for the fabric in the longitudinal direction. Structural integrity in the transverse direction is derived from the floats, the ends of the floats having been knit into spaced rows of the chain stitches.

Preferably the floats 14*a* have a stitch interval of greater length than the stitch interval of the loop facing. This provides for better lift to the floats during the napping, and a higher loop densitiy of the loop face, again assisting in the subsequently performed napping operations.

Figure 14:
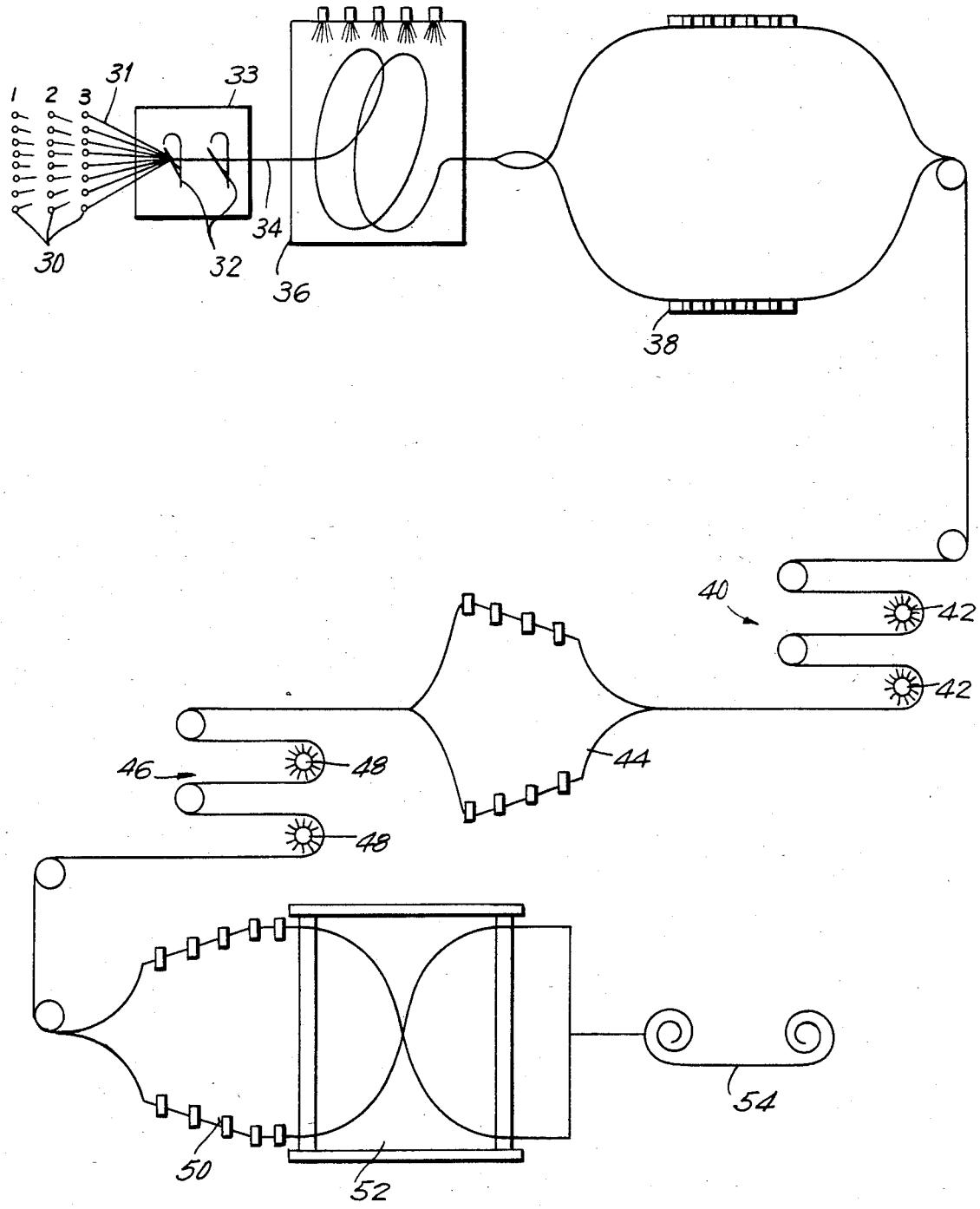
FIGS. 14 and 15 are flow diagrams of the steps in the method of forming the fabric of the present invention.
Figure 15:
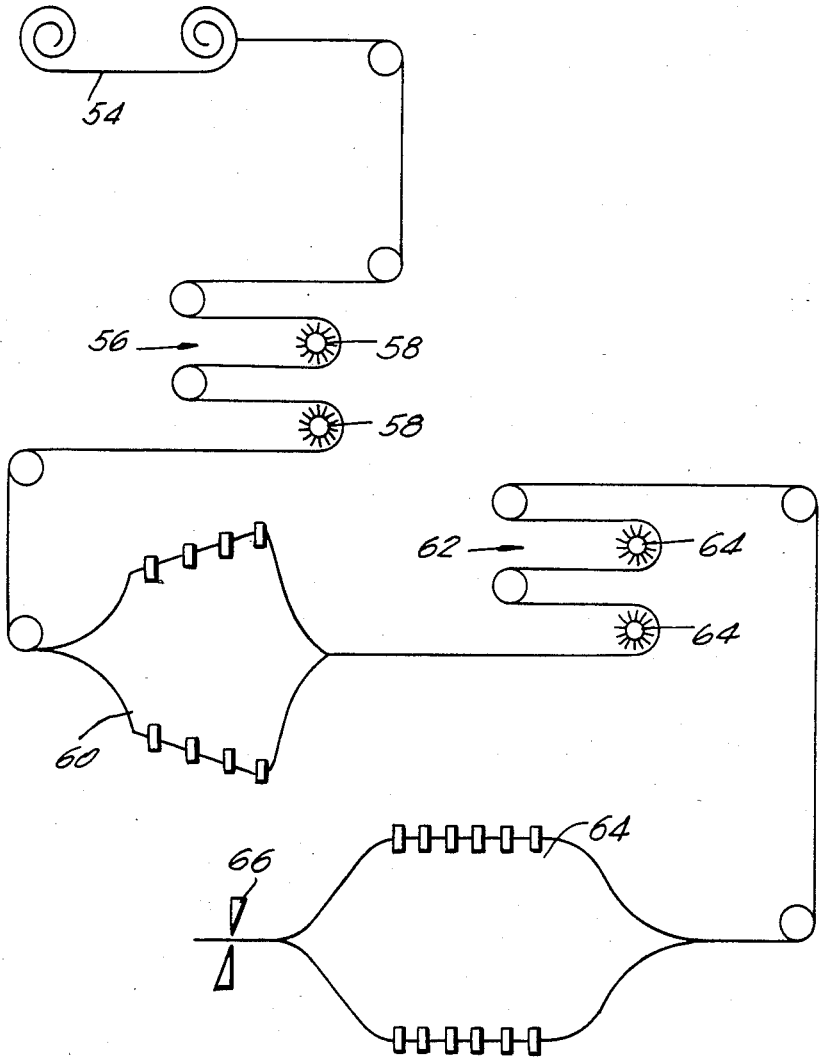

The manner of forming the blanket material from the knit fabric of FIGS. 1 through 13 is illustrated in the flow diagrams of FIGS. 14 and 15, which, conveniently show the operation as being a continuous operation. The extent to which the operations can be continuous will, of course, depend on the availability of machinery and equipment, and preferably are a series of sequential operations in order to optimize the use of available machinery and equipment.

Referring now to FIG. 14, the three bars of the knitting machine are indicated at 30 as feeding yarns 31 to the needles 32 of a knitting machine indicated by the block 33.

The knit fabric 34 emerging from the knitting machine is fed to a continuous jet dyeing apparatus, indicated at 36. If the dyeing of the fabric is to be carried out in an autoclave-type jet dyeing apparatus, then, the knit fabric is reeled as it emerges from the knitting machine, and subsequently is transferred into the autoclave and jet dyed. In the jet dyer, the fabric is dyed under heat and pressure, the dyestuffs being applied to the fabric in high pressure jets. This operation has the advantage of bulking up the fabric before the further processing thereof. After dyeing, excess dyestuff is removed, the fabric is subject to a mordanting operation, and is then washed preparatory to the next processing step.

On emerging from the jet dyer, the dyed and bulked-up fabric is fed to a framing or drying apparatus 38, and is dried under longitudinal and transverse tension. In the event that the yarns forming the fabric have been bulk dyed prior to the knitting operation to form facings of the fabric of different colors, then, the jet dyeing, framing and drying steps are eliminated.

The dyed, framed and dried fabric is then fed to a first napper in which the float face of the fabric is partially napped to initiate the lofting of the pile of the fibers of that face. Preferably the napper is a tandem napper having oppositely rotating napping cylinders 42, which sequentially raise the pile of the fibers and then tuck stray fiber ends back into the napped pile.

The napping may be accomplished by either by a tandem napping process or a single napping process. Either napping operation causes drawing-up of the fabric in the transverse direction and a decrease in the width of the fabric.

In the tandem napping process the fabric is passed through the napping equipment in a single pass and the rotating napping cylinders 48 sequentially raise the pile of the float face and then tuck the loose ends of the napped fibers back into the napped surface.

In the single-napping procedure the fabric is passed through one napper in two separate passes, the fabric being fed into the napper in the same direction on the second pass. This achieves the same level of raising and lofting of the fibers as is achieved in a single pass of a tandem napper. Optionally at this step in the processing, the partially napped fabric is fed to a tenter 44 and is restored to its original width prior to the fabric being fed to a second napper 46 in which the lofting of the fibers of the float face is completed. Again, preferably the napper is a tandem napper having oppositely rotating napping cylinders 48 which sequentially raise the pile of the float face and then tuck the loose ends of the napped fibers back into the napped surface. The second napper may, of course, be the same piece of equipment providing the first napper, in which event the fabric would be reeled between the respective operations.

It has been found that the integrity of the fabric will be maintained even if in excess of 60% of the fibers of the floats are severed in the napping operation.

Resulting from the napping steps, the fabric will have become drawn up in the transverse direction. The fabric is then fed to a tenter 50 and restored to an acceptable width for further processing. The fabric is then framed and its faces reversed in the apparatus indicated at 52, preparatory to the subsequent processing steps.

Figure 16:
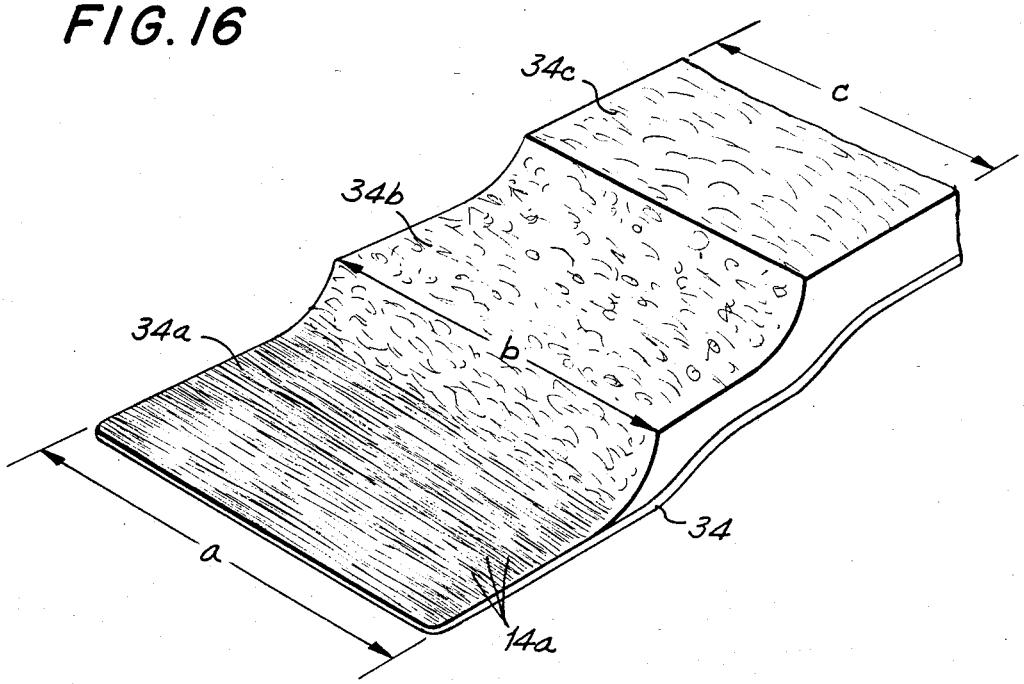
FIG. 16 is a fragmentary perspective view of the float face of the fabric progressing from the greige through successive napping steps.

The processing steps so far described have the effect of converting the initial fabric 34 progressively to the form shown in FIG. 16, reference now being made to that Figure. At the commencement of the napping operations, the fabric 34 is positioned with its float face 34*a* for presentation to the sequential napping cylinders 42 and 48. The pass through the first napper 40 produces a partial raising and napping of the floats alone of the fabric, and, a consequential drawing in of the fabric. The subsequent napping operation finalizes the napping and tucking operations and the final formation of the loft of the fibers on the float face as indicated at 34*c*, again producing a transverse drawing in of the fabric, such that the width of the fabric indicated at a, progressively is decreased to a width b, and then to a width c. In the event that the optional tenter 44 is employed, then, on the final tenter the width of the fabric b or c will more closely approximately the starting width a.

Figure 17:
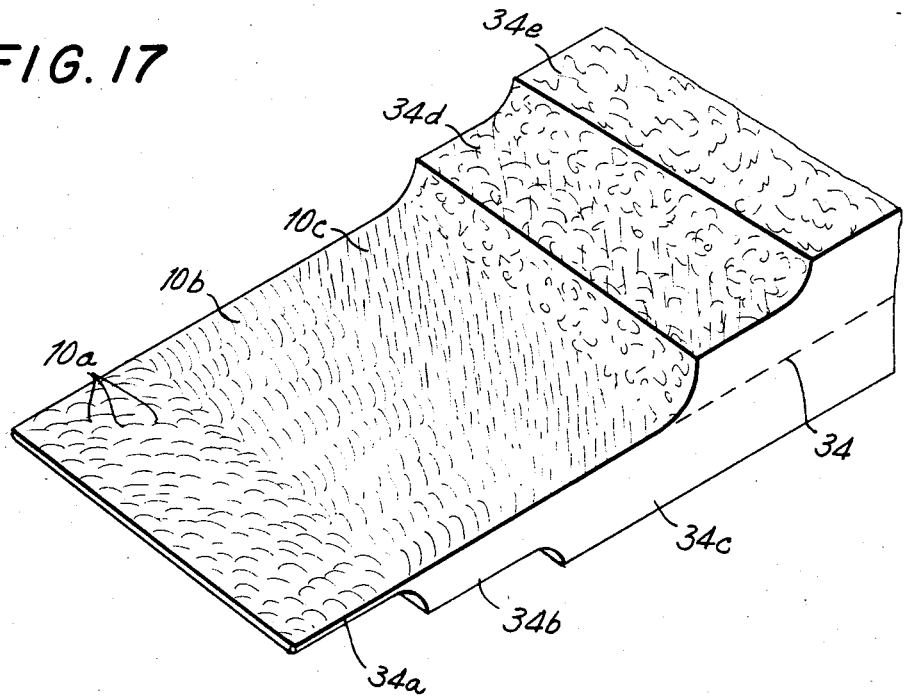
FIG. 17 is a fragmentary perspective view of the loop face of the fabric, progressing from the greige through the successive napping steps of the float face, and then the progressive napping steps of the loop face.

This progressive reduction in the width of the fabric in the nappers 40 and 46 raises the loops on the loop face of the fabric, such as graphically shown in FIG. 17.

In FIG. 17 the initial fabric is indicated at 34*a*, and, the sequential napping steps which have been performed on the float face are indicated at 34*b* and 34*c*. Prior to commencement of the first napping operation 34*b*, the yarn loops 10 have a tendency to lay flat. In such a condition, the loops are not in their most advantageous position for napping, and, if that side of the fabric was the first to be napped, then an additional processing step in raising of the loops would be desirable before the napping operation could be carried out on the loop face. For example the loop face could be brushed up and possibly heat set or steamed to maintain them in somewhat erect condition.

It is, however, found that these additional processing steps are not required in that the napping operation performed on the float face of the fabric at 34*b* causes the loops to raise up without the intervention of any additional processing step. Further, it is found that the second napping operation performed on the float face at 34*c* has the result of erecting the loops such that they are properly disposed in generally perpendicular arrangement to the face of the fabric and readied for the napping operations to be performed on the loop face of the fabric. It is further found that the consequential drawing-in of the width of the fabric has the beneficial effects of improving the erection of the loops for subsequent napping, and, increasing the loop density of the loops on the looped face.

Referring to FIGS. 14 and 15, the fabric napped on the float face is reversed in the apparatus 52, and, optionally is reeled and then re-reeled to reverse it end-for-end, as indicated at 54. This readies the loop face for subsequent napping and orients the loops in a position in which they are optimally arranged for napping. Then, as illustrated in FIG. 15, the loop face of the fabric is fed to a first tandem napper 56 having napping drums 58, the napping drums 58 preferably being counter-rotating such that they act to raise and loft the pile of the loop face, and then tuck in stray ends of the lofted fibers. The fabric is then subjected to an optional tentering operation at 60, subsequent to which it is subjected to a second napping operation in a tandem napper 62 having napping drums 64. As will be appreciated, in a semi-continuous operation the same tandem napper may be used for the nappers 40, 46, 56 and 62 and the same tenter may be used for the tenters 44, 50 and 60.

Subsequent to the second napping operation in the napper 62 and finalization of the raising of the loft of the fibers of the loop side of the fabric, the fabric is then framed and heat set in the apparatus 64, subsequent to which it is sheared into convenient lengths by a shear 66. The fabric emerging from the framing and setting apparatus 64 is the finished fabric for use as a blanket material or garment material.

The respective first and second nappings of the loop face are indicated at 34*d*, 34*e* in FIG. 17.

The foregoing discussion is exemplary of fabrics which may be produced in accordance with the present invention. Numerous variations are contemplated without departing from the scope of the appended claims. While the denier of the yarns used in the top, middle and bottom bars are illustrated as 75, 20 and 40, respectively, in each instance the deniers may be either increased or decreased depending on the required finished weight of the fabric. Finished weights in the range of 2 ounces per square yard up to as high as 20 ounces per square yard are contemplated by suitably modifying the gauge of the knitting machine and the size of the yarns. Yarn deniers in the range of 40–100 or equivalent yarn sizes are contemplated in respect of each of the top and bottom bars, and, yarn deniers in the range of 15–100 or equivalent yarn sizes in respect of the middle bar.

While preferred embodiments have been illustrated they are merely representative of various alternatives within the scope of the appended claims which may be executed by those skilled in the arts.

I claim:

1. A double faced knit fabric having particular utility as a bedding blanket, said fabric being of at least three bar construction and comprised of:

a support substrate of warp-knit yarns;

a first facing of warp knit, overfed looped and napped yarns knit into said support substrate; and, an opposite facing of warp-knit napped floats of yarns, the yarns of said opposite facing being knit into said support substrate at the ends of the floats;

the fibers of said substrate being substantially intact and unbroken, and providing longitudinal stability to said fabric;

at least a portion of the fibers of said opposite facing being intact and unbroken and providing lateral stability to said fabric.

2. The fabric of claim 1, in which substantially 60% of the fibers of said floats are napped, the remaining fibers being unnapped and providing said lateral stability.

3. The fabric of claim 1, in which the yarns of said first facing are formed from fibers different from the fibers of the yarns forming the opposite facing.

4. The fabric of claim 3, in which the fibers of the yarns of said first facing have a dye retentivity different from the dye retentivity of the fibers of the yarns of said opposite facing.

5. The fabric of claim 1, in which the support substrate is comprised of continuous filament yarn.

6. The fabric of claim 1 in which the stitch interval of said first facing is greater than the stitch interval of said substrate, and the stitch interval of said opposite facing is greater than the stitch interval of said first facing.

7. The fabric of claim 1, in which the loops of said first facing have a height of at least in the order of 0.1 mm.

8. A method of forming a double faced knit fabric having particular utility as a bedding blanket, and which is comprised of:

a support substrate of warp-knit yarns;

a first facing of warp knit, overfed looped and napped yarns knit into said support substrate; and, an opposite facing of warp-knit napped floats of yarns, the yarns of said opposite facing being knit into said support substrate at the ends of the floats;

the fibers of said substrate being substantially intact and unbroken, and providing longitudinal stability to said fabric;

at least a portion of the fibers of said opposite facing being intact and unbroken and providing lateral stability to said fabric, said method comprising the steps of:

warp knitting a support substrate on a middle bar of a knitting machine having at least three bars, the stitches of said substrate providing longitudinal stability of said fabric;

simultaneously warp knitting a first facing into said substrate on a bottom bar of said knitting machine, the yarns of said first facing being overfed during the knitting of said first facing into said substrate and providing nappable loops;

simultaneously warp knitting an opposite facing into said substrate on a top bar of said knitting machine, the yarns of said opposite facing providing nappable floats; and subsequently napping the yarns of both said facings to enhance the pile and loft fibers thereof, the extent of napping being such as to nap the facings alone in the substantial absence of any breakage of the fibers of said substrate, the napping being to an extent preserving sufficient of the fibers of the yarns of said opposite float facing intact and unbroken for them to provide lateral stability to said fabric.

9. The method of claim 8, including the step of overfeeding the yarns of the first facing under less than normal tension to provide loops having a height at least in the order of 0.1 mm.

10. The method of claim 8, in which substantially 60% of the fibers of said floats are napped, the remaining fibers of said floats being unnapped and providing lateral stability to said fabric.

11. The method of claim 8, in which the yarns of said one facing has characteristics dissimilar to the yarns of said opposite facing.

12. The method of claim 11, in which the yarns of said first facing has a dye retentivity different from the dye retentivity of the yarns of the opposite facing.

13. The method of claim 8, in which the yarns of said first facing are knit in a pattern producing a stitch interval greater than the stitch interval of said substrate, and the yarns of said opposite facing are knit on a pattern producing a stitch interval greater than the stitch interval of said first facing.

14. The method of claim 8, including the further steps of first napping said opposite float facing of the knit fabric, subsequently napping the said float loop facing of the knit fabric, and then subsequently framing and heat setting the napped fabric.

15. The method of claim 14, including the step of tentering the fabric intermediate the napping of said opposite float facing of the knit fabric and the subsequent napping of said first loop facing of said knit fabric.

* * * * *